United States Patent [19]

Walker

[11] 4,170,035

[45] Oct. 2, 1979

[54] DISPLAY LAMP HAVING A TRANSLUCENT ENVELOPE

[75] Inventor: Edward C. Walker, Ringwood, England

[73] Assignee: Crestworth Limited, Dorset, England

[21] Appl. No.: 840,744

[22] Filed: Oct. 11, 1977

[30] Foreign Application Priority Data

Oct. 13, 1976 [GB] United Kingdom ..... 42567/76

[51] Int. Cl.[2] ..... F21V 7/04

[52] U.S. Cl. ..... 362/31; 362/96; 362/318; 362/806

[58] Field of Search ..... 40/406, 412, 441, 477; 362/31, 96, 125, 126, 154, 252, 318, 363, 811, 806

[56] References Cited

U.S. PATENT DOCUMENTS

| | | | |
|---|---|---|---|
| 1,786,183 | 12/1930 | Wilson | 362/96 X |
| 2,146,422 | 2/1939 | Davis | 362/811 X |
| 2,804,540 | 8/1957 | Columbus et al. | 362/31 X |
| 2,986,982 | 6/1961 | Kaprelian | 362/318 X |
| 3,392,466 | 7/1968 | Lo Guidice | 40/406 |
| 3,610,916 | 10/1971 | Meehan | 362/363 |
| 3,711,698 | 1/1973 | Hess | 362/318 X |
| 3,762,082 | 10/1973 | Mincy | 362/811 X |
| 3,964,194 | 6/1976 | Gugeler | 362/318 X |
| 3,995,151 | 11/1976 | Nordeen et al. | 362/96 |

FOREIGN PATENT DOCUMENTS

| | | | |
|---|---|---|---|
| 47621 | 3/1937 | France | 362/318 |
| 374821 | 12/1930 | United Kingdom | 362/318 |

*Primary Examiner*—Peter A. Nelson
*Attorney, Agent, or Firm*—Fay & Sharpe

[57] ABSTRACT

A display lamp which includes a container and a source of light and heat mounted adjacent to the container, and, within the container, a liquid in which are suspended a number of insoluble reflecting flakes, the container being substantially surrounded by an envelope at least part of which is translucent.

10 Claims, 1 Drawing Figure

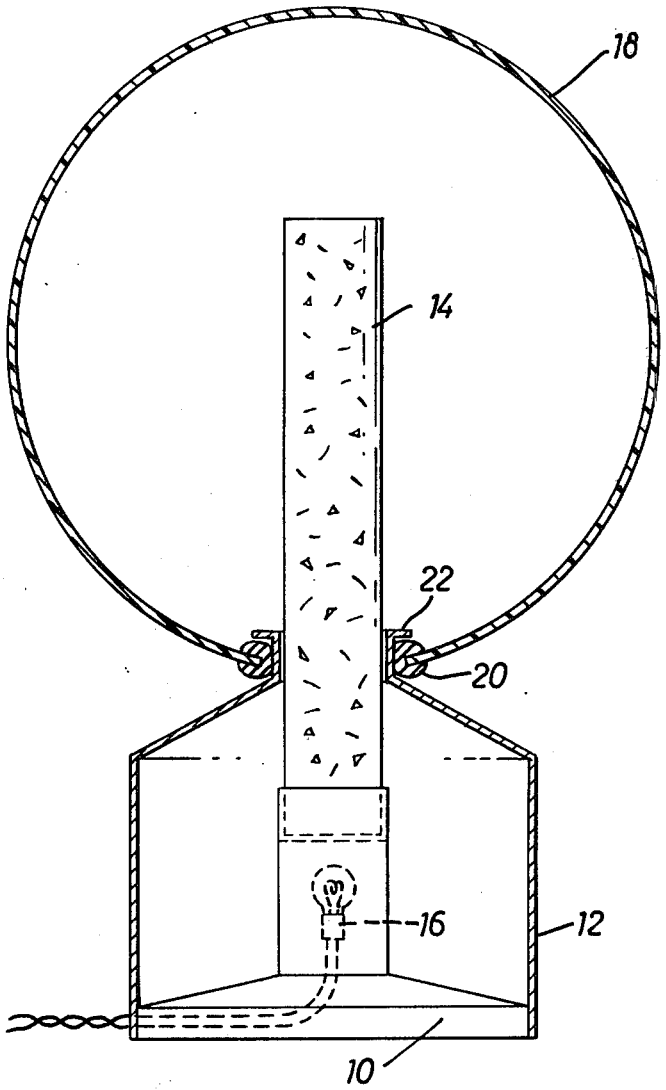
18
14
22
20
16
12
10

DISPLAY LAMP HAVING A TRANSLUCENT ENVELOPE

This invention relates to a display lamp.

A display lamp has been proposed in British Pat. No. 1 232 311 which comprises a closed transparent or translucent container holding a liquid, a source of light and heat mounted beneath the container to heat and illuminate the container contents and, suspended in the liquid, a number of insoluble flakes which are solid and upon the application of heat from the source, remain solid and have a specific gravity which is substantially the same as that of the liquid so that they will circulate in the liquid under convection currents. It has been unexpectedly found that an entirely different visual impression can be obtained if the container of such a lamp is enclosed in an envelope which is at least partly translucent or transparent.

According to the invention, there is provided a display lamp which includes a container and a source of light and heat mounted adjacent to the container, and, within the container, a liquid in which are suspended a number of insoluble reflecting flakes, the container being substantially surrounded by an envelope at least part of which is translucent.

The translucent envelope acts as a screen and constantly-changing patterns of light arising from the random movement of the flakes are reflected, in use, by the flakes onto the screen. By colouring the wall of the container adjacent to the light source, or by interposing a screen of variegated colours the constantly changing patterns can be made to vary in colour as well as in shape.

The envelope may be generally spherical, and may be made of a synthetic plastics material of the "PERSPEX" or "DARVIC" type. These materials are sold by Imperial Chemical Industries Ltd. The envelope may be made in two complementary halves, secured together by adhesive or by suitable clips. Alternatively the two parts may be constructed as a tight push fit one into the other. Making the envelope in two halves simplifies packing. Of course the envelope will not be in the form of a complete sphere. A portion of the wall of a completely spherical envelope will be cut away to allow the container to project into the interior of the envelope. It is preferred that the major portion of the container should be disposed within the envelope.

In the alternative, the envelope may be cylindrical or pyramidal or any other shape required by the desired appearance of the lamp. The container may be mounted on a base of which a lower part is visible beneath the envelope, or the envelope may enclose the base and the container carried thereby.

In a preferred embodiment of the invention, the lamp includes a supporting base having an internal space therein defined by inner and outer walls. The envelope is carried by the outer base wall and is connected thereto in a liquid-tight fashion. The container is carried by the inner base. The purpose of this construction is to prevent any liquid which may escape from the container from reaching the outside of the envelope. In the case of a breakage of the container, the liquid runs from the enclosure into the space between the inner and outer base walls.

The enclosure may be made by moulding two halves thereof by a conventional synthetic plastics moulding operation. The flakes may be of plastics and light-reflective or coated with light reflective metal such as aluminium. The flakes should be as thin as possible, preferably less than 0.0005 inch or even less than 0.00025 inch thick and may be cut into tiny polygonal shapes such as triangles, rectangles and diamond shapes.

The invention will be better understood from the following description of an illustrative embodiment thereof, given with reference to the accompanying drawing which is a side elevation, partly in section, of one form of lamp in accordance with the invention.

The illustrated display lamp includes an inner base 10, an outer base 12, a transparent container 14 of light transmitting material having a light transmitting liquid therein, there being suspended in the liquid a plurality of insoluble light reflective particles or flakes having a specific gravity close to that of the liquid, and a source of light 16. The bottom wall of the container is coloured in any desired pattern. The lamp also includes an envelope 18 at least part of which is translucent. The envelope 18 surrounds the container. Although in the drawing a lower part of the container 14 is shown as outside the envelope 18, it will be appreciated that the inner base 10 can be made higher so that substantially all of the container 14 is within the enclosure 18. This latter arrangement allows one to obtain the maximum intensity of light reflected onto the inner surface of the envelope 18. The envelope 18 may be supported by the outer base 12. Alternatively the envelope 18 may be connected in a liquid-tight fashion to the outer base 12. In this case, a liquid seal therebetween constituted by a sealing ring 20 may be retained in a recess formed by suitably shaping the upper portion 22 of the outer base 12.

In the illustrated embodiment of the invention, the envelope is substantially spherical in shape and is formed by 2 generally hemispherical halves which may clip together or may be secured together by adhesive or in any other convenient way. Although all or part of the envelope may be translucent, it is preferred that at least half its area is translucent. In this way, it acts as a screen upon which pleasing and fascinating continuously changing coloured patterns are thrown by the effect of the insoluble reflective flakes moving under convection currents, thereby reflecting the light from the source 16 onto the translucent screen portion of the envelope 18.

It is an optional feature of the invention that the envelope 18 may serve to retain the liquid within the confines of the lamp, even if the container 14 breaks or starts to leak. For this purpose, it is arranged that the internal diameter of the neck portion of the outer base 12 is slightly greater than the external diameter of the container 14. Thus any liquid which may escape is retained within the envelope 18 and travels under gravity into the space between the outer base 12 and the inner base 10. In this way, the stability of the lamp is increased and the escaped liquid can do no harm until it is possible for the lamp to be removed and the liquid disposed of.

One example of a liquid which may be used within the container 14 is perchloroethylene, and the envelope 18 may be of a synthetic plastics material such as "PERSPEX" or "DARVIC." Alternatively, it could be made of coloured or frosted or treated glass. The light source 16 may be a tungsten halogen lamp. The insoluble flakes are preferably of a plastics material coated with a light reflective material. Advantageously they have a thickness of less than 0.0005 inch. The liquid in the container 14 may alternatively be trichloroethane.

The translucent portion of the envelope 18 is preferably white, but may be coloured. If coloured, it should preferably be a pastel shade of colour rather than a strong primary colour. The envelope 18, although illustrated as generally spherical, may of course be any desired shape according to the aesthetic requirements of the designer. For example, it may be rectangular, cylindrical, or a three-dimensional shape made up of a plurality of equal polygons.

The flakes may be of plastics and light-reflective or coated with light reflective metal such as aluminium. The flakes should be as thin as possible, preferably less than 0.0005 inch or even less than 0.00025 inch thick and may be cut into tiny polygonal shapes such as triangles, rectangles and diamond shapes.

In an advantageous version of the invention, a portion of the container wall near to the light source may be coloured so that the light from the source striking the insoluble flakes, and reflected thereby, gives attractive coloured effects. For example, the container may be cylindrical and its bottom wall coloured red, blue and green in three equal sectors, or in three stripes of equal width.

I claim:

1. A display lamp comprising:

(a) a base, (b) a container of light transmitting material carried by and upstanding from said base, said container having a lower wall, (c) a light transmitting liquid within said container, (d) a plurality of insoluble light reflecting particles suspended within said liquid, said particles and liquid having substantially the same specific gravity, (e) a heat producing light source mounted within said base adjacent said lower wall of said container for transmitting light through said liquid for reflection by said particles outwardly through said container as multiple light beams and for heating said liquid to create convection currents which agitate said particles for imparting movement to the light beams reflected thereby and varying the size and shape thereof, and (f) an envelope positioned in outwardly-spaced substantially surrounding relationship to said container and having a substantial translucent area acting as a screen on which said light beams reflected by said particles are projected to produce thereon a continuously varying random light pattern visible externally of said envelope.

2. A lamp according to claim 1 in which the envelope is generally spherical.

3. A lamp according to claim 1 in which the envelope is made of a synthetic plastics material of the acrylic type.

4. A lamp according to claim 1 in which the envelope is made in two complementary halves, secured together by securing means.

5. A lamp according to claim 1 in which the envelope is made in two complementary halves and the two halves are constructed as a tight push fit one into the other.

6. A lamp according to claim 1 in which the base has inner and outer walls which define a space therein, the envelope being carried by the outer base wall and being connected thereto by liquid-tight sealing means.

7. A lamp according to claim 1 in which the base has an inner base structure having an upwardly-opening recess adapted to securely receive and support a lower end of the container.

8. A display lamp according to claim 7 in which the said base is an outer base which supports but is not connected to the inner base structure.

9. The lamp as defined in claim 1 wherein said heat producing light source includes means for transmitting light of a plurality of different colors through said liquid for reflection as different colored beams of light by said particles so that the varying random pattern on said envelope also has varying colors.

10. The lamp as defined in claim 9 wherein said lower wall of said container is transparent.

* * * * *